US006325817B1

(12) United States Patent
Shen

(10) Patent No.: US 6,325,817 B1
(45) Date of Patent: Dec. 4, 2001

(54) NIPPLE FOR REMOVING LACTIC ACID

(76) Inventor: Thomas Y. Shen, No. 63-2, Sec. 1, Cheng-Kung Rd., Taipei (TW)

( * ) Notice: Subject to any disclaimer, the term of this patent is extended or adjusted under 35 U.S.C. 154(b) by 0 days.

(21) Appl. No.: 09/477,374

(22) Filed: Jan. 4, 2000

(51) Int. Cl.[7] ..... A61J 17/00
(52) U.S. Cl. ..... 606/236; 606/234; 215/11.1
(58) Field of Search ..... 606/234–236; 215/11.1–11.2, 11.5; 601/139; 132/309

(56) References Cited

U.S. PATENT DOCUMENTS 1,207,120 * 12/1916 Younker ..... 215/11.1
2,115,405 * 4/1938 Allen ..... 606/235
5,190,174 * 3/1993 Klag ..... 215/11.1
5,553,726 * 9/1996 Park ..... 215/11.4
5,662,685 * 9/1997 Uhler ..... 606/234
5,711,759 * 1/1998 Smith et al. ..... 606/139
6,003,698 * 12/1999 Morano ..... 215/11.1

* cited by examiner

*Primary Examiner*—Kennedy Schaetzle
*Assistant Examiner*—Kute Droesch
(74) *Attorney, Agent, or Firm*—Bacon & Thomas, PLLC

(57) ABSTRACT

An improved nipple comprises a grip part, a stop part located at a front end of the grip part, a sucking part coupled with the stop part, at least two pieces of annular body are arranged at a proper position of the sucking part, wherein a clearance is provided between two adjacent bodies. After feeding and when a baby is sucking the nipple, he is holding the sucking part in mouth, meanwhile, his upper and lower incisors are inserted in the clearance, and the pieces of the piece body are pinching the upper and the lower incisors on both sides thereof to remove the remaining lactic acid on the incisors.

1 Claim, 6 Drawing Sheets

NIPPLE FOR REMOVING LACTIC ACID

BACKGROUND OF THE INVENTION

This invention relates to an improved structure of nipple for an infant, and particularly to a nipple that can remove the lactic acid remained on the incisors of the infant after feeding in order to prevent "nipple-type" tooth decay.

It is reported that the infant delivery rate has climbed up to 80 millions in average per year, and all the infants are facing a common problem—tooth decay, or the so-called "nipple type" tooth decay in medical science. An infant with baby teeth is liable to have his incisors decayed owing to lack of saliva secretion so that the lactic acid will remain to etch his incisors while it is not the case for his rest teeth, which are always wetted by the saliva. However, this phenomenon of "nipple type" tooth decay would not happen to those babies who are fed with mother's milk, and nevertheless, it comes back very soon after a feeding bottle is substituted for the mother's milk for the reason that a baby's teeth grow large enough to accidentally bite and hurt his mother's nipple when sucking.

SUMMARY OF THE INVENTION

The primary object of this invention is to provide a nipple made of silicon rubber that can remove the lactic acid remaining on a baby's teeth, which is then carried away by the saliva, when the baby is sucking a feeding bottle or a false (pacifying) nipple.

Another object of this invention is to massage the gums for reducing itch which accompanies tooth growth in addition to removing the lactic acid remaining on the incisors after feeding.

In order to realize the abovesaid objects, at least or more than two pieces of an annula body are spaced on a sucking part of the nipple in the way that a clearance is provided between the two adjacent bodies. When a baby is sucking the nipple, he is holding the sucking part in his mouth, meanwhile, his upper and lower incisors are inserted in the clearance, and the bodies pinch against the upper and the lower incisors on both sides to remove the remaining lactic acid on the incisors for preventing the so-called "nipple type" tooth decay recognized in medical science.

BRIEF DESCRIPTION OF THE DRAWINGS

For a better understanding to the present invention, together with further advantages or features thereof, preferred embodiments will be detailed below with reference to the annexed drawings in which.

DETAILED DESCRIPTION OF THE PREFERRED EMBODIMENTS

Figure 1:
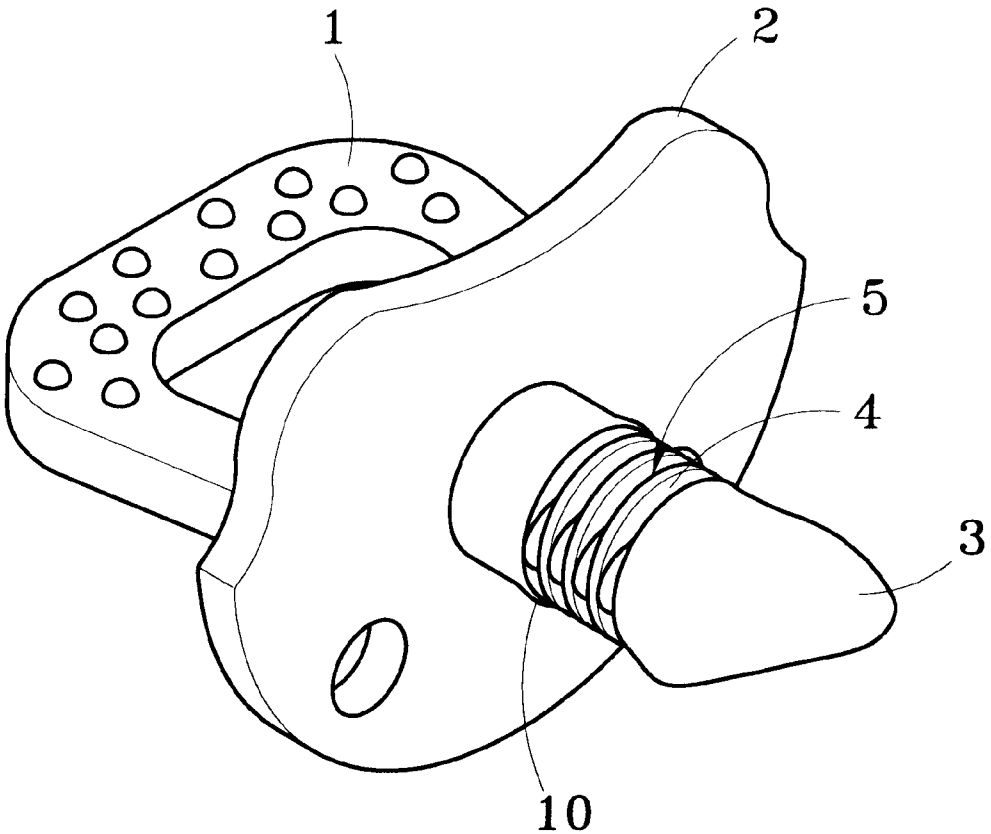
FIG. 1 is a schematic view showing a first embodiment of this invention.
Figure 3:
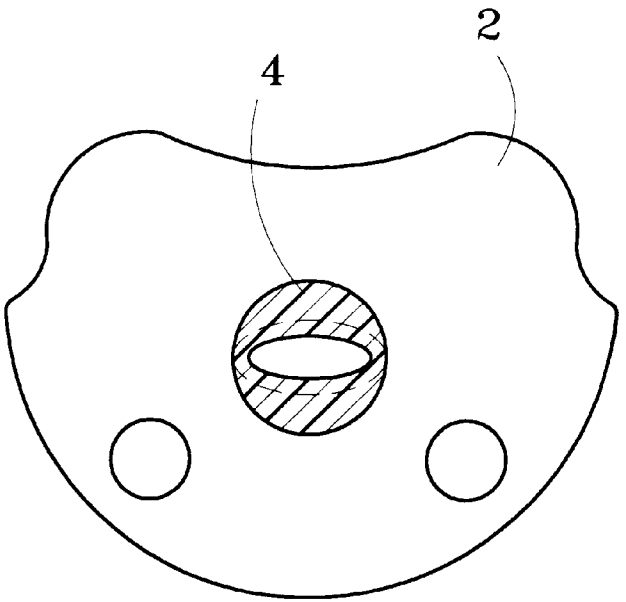
FIG. 3 is a cutaway sectional view taken along line III—III in FIG. 2.
Figure 2:
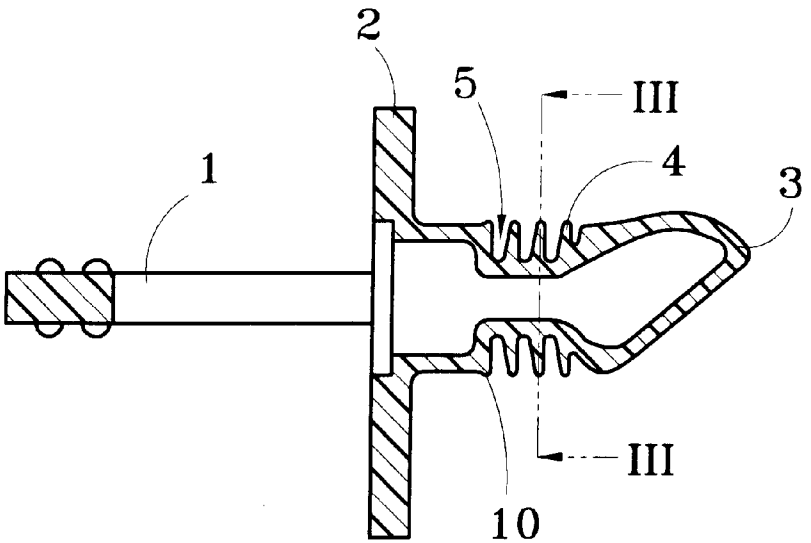
FIG. 2 is a cutaway sectional view of FIG. 1.
Figure 4:
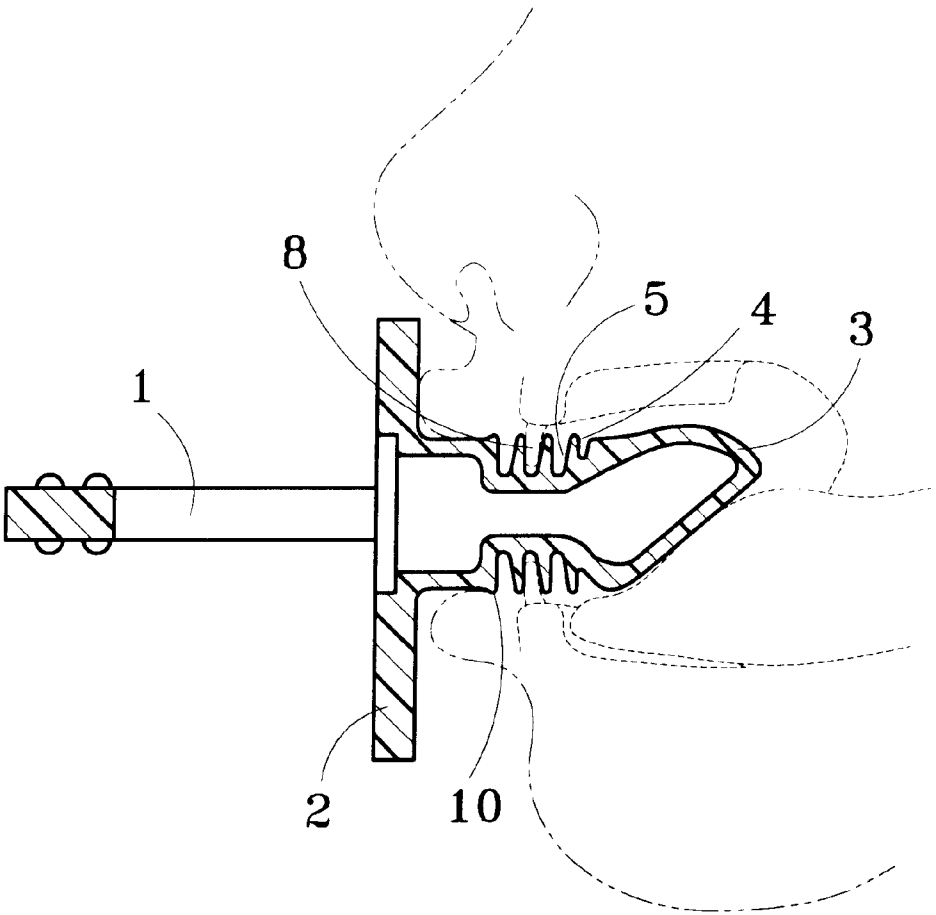
FIG. 4 is a schematic view showing that an infant is sucking this invention.

As shown in FIG. 1 through FIG. 4, this invention is mainly to provide an improved nipple that can remove the lactic acid remaining on a baby's teeth after feeding so as to prevent the "nipple type" tooth decay. The abovesaid nipple, forming a part of a pacifier, is made of silicon rubber by integral molding. The nipple device comprises a grip part 1, a stop part 2 located at a front end of the grip part 1, a sucking part 3 coupled with the stop part 2. Interposed between the sucking part 3 and the stop part 2 is a nipple shaft 10. The nipple shaft 10 has at least two annular-shaped bodies 4 arranged at a proper position near the sucking part 3, and extending radially outward a sufficient distance wherein a clearance 5 is provided between two axially spaced and adjacent annular-shaped bodies 4. After feeding and when a baby is sucking the nipple, he is holding the sucking part 3 in his mouth, meanwhile, his upper and lower incisors 8 are inserted in the clearance 5, and the bodies 4 engage the upper and the lower incisors 8 on both sides thereof to remove the remaining lactic acid on the incisors 8 for the saliva to carry away. The forgoing tooth-hygienic manner is something just like when the baby brushes his teeth by himself from time to time.

Figure 5:
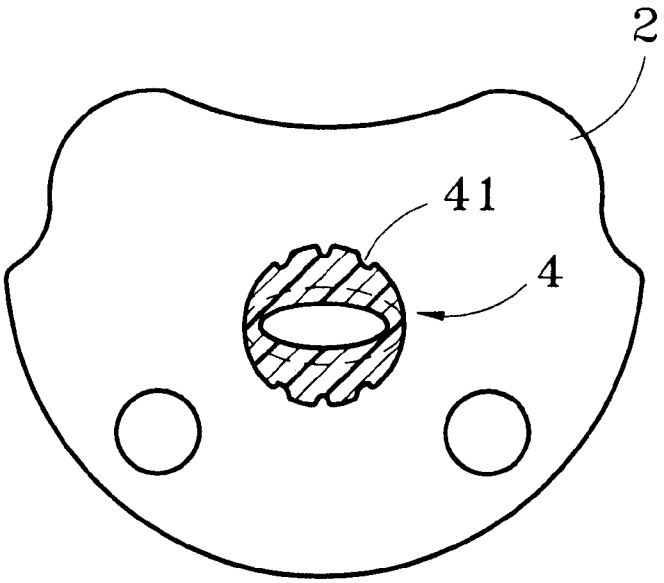
FIG. 5 is a schematic view showing a second embodiment of this invention.

Referring to FIG. 5, a plurality of spaced gaps 41 are formed in a peripheral rim of the body 4 and resemble gear teeth, which is helpful in removing the lactic acid remaining on the incisors 8.

Figure 6:
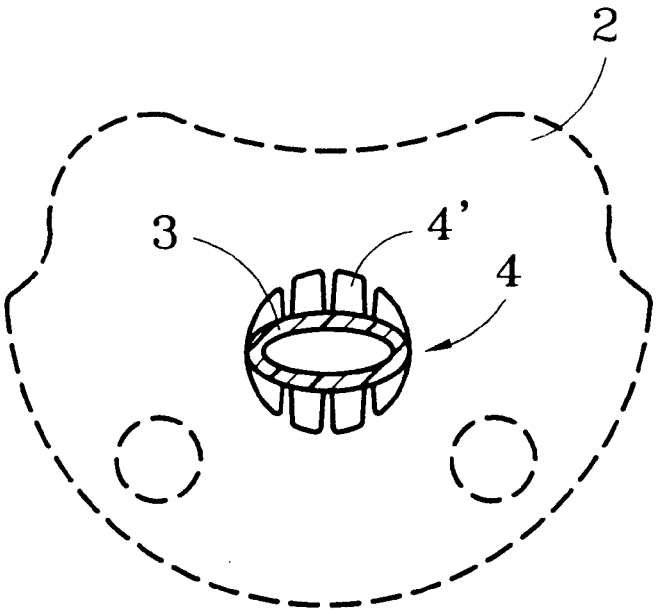
FIG. 6 is a schematic view showing a third embodiment of this invention.

As FIG. 6 indicates, the body 4 may be made in the form of a plurality of outwardly projecting rib members 4', which can wriggle softly to press against the incisors 8 for removing the lactic acid effectively.

Figure 8:
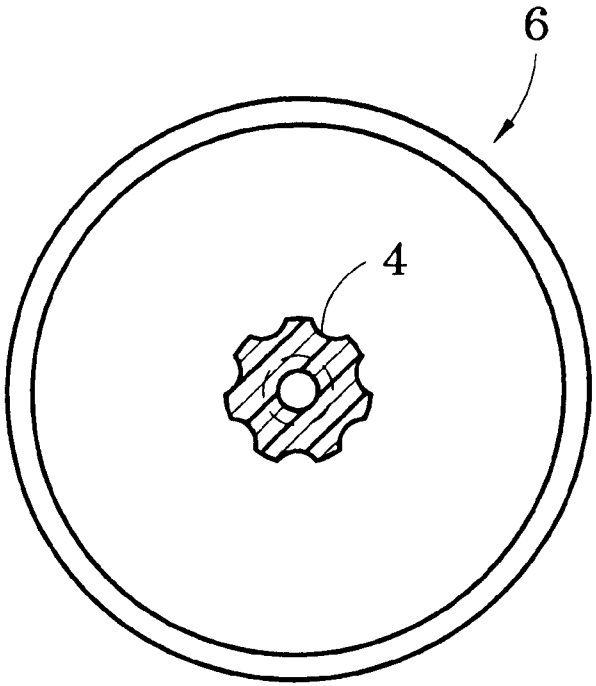
FIG. 8 is a cutaway sectional view taken along line VII—VII in FIG. 7.
Figure 7:
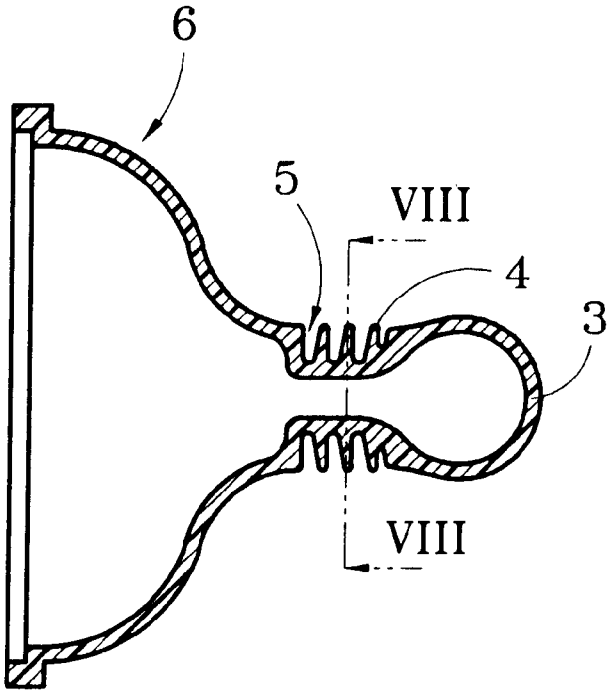
FIG. 7 is a schematic view showing a fourth embodiment of this invention.

As shown in FIGS. 7 and 8, the piece body 4 mentioned in abovesaid embodiments is also applicable in a nipple 6 residing on a feeding bottle to function as described above.

Figure 9:
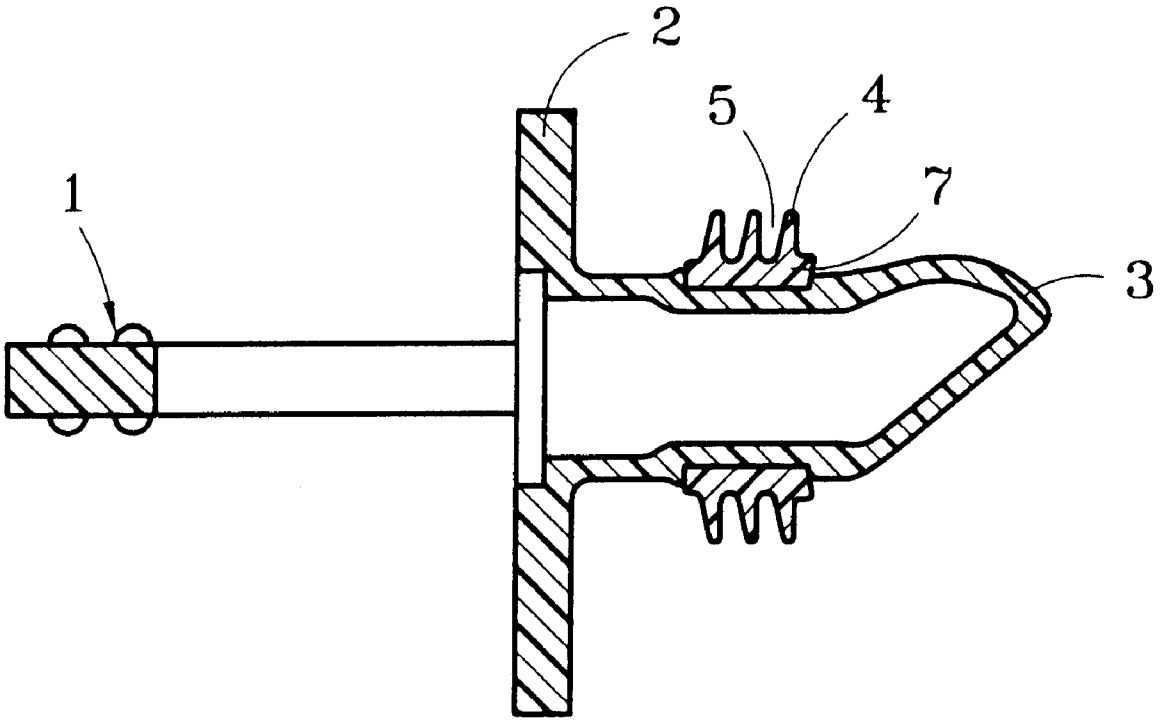
FIG. 9 is a schematic view showing a fifth embodiment of this invention.

In FIG. 9, the body 4 is mounted directly on a open-ended cylindrical thimble 7 that is then sleeved onto the sucking part 3 of the nipple to function as above. This design of the body 4 provides a conventional nipple immediate improvement.

Moreover, in addition to removing the lactic acid on a baby's incisors 8, the body 4 of this invention can meanwhile massage the gums to reduce the itch that comes along with tooth growth.

Although, this invention has been described in terms of preferred embodiments, it is apparent that numerous variations and modifications may be made without departing from the true spirit and scope thereof, as set forth in the following claims.

What is claimed is:

1. A nipple device for an infant nursing bottle or pacifier, the device comprising a nipple having a sucking part and a shaft, at least two adjacent annular-shaped portions each continuously and circumferentially extending around the nipple shaft and having a substantially equal diameter to each other, each of said portions forming a plurality of spaced gaps formed around the periphery of the portion, said portions being axially spaced from each other and extending radially outwardly from the nipple shaft to form a clearance between each of the portions, the clearance being of sufficient size for receiving and pinching both sides of the upper and lower incisors of an infant to remove lactic acid therefrom and prevent tooth decay.

* * * * *